US005129139A

United States Patent [19]

Sakamura

[11] Patent Number: 5,129,139

[45] Date of Patent: Jul. 14, 1992

[54] DEVICE FOR USE IN A FORMER FOR AUTOMATICALLY REPLACING PUNCHES

[76] Inventor: Yoshikazu Sakamura, 6-24, 2-chome, Uehonmachi-nishi, Chuo-ku, Osaka-shi, Japan

[21] Appl. No.: 722,556

[22] Filed: Jun. 25, 1991

[30] Foreign Application Priority Data

Aug. 9, 1990 [JP] Japan ..... 2-85245

[51] Int. Cl.[5] ..... B23Q 3/155

[52] U.S. Cl. ..... 483/29; 83/698

[58] Field of Search ..... 83/571, 549, 550, 684, 83/698; 29/568, 26 A; 72/446

[56] References Cited

U.S. PATENT DOCUMENTS

| | | | |
|---|---|---|---|
| 3,727,301 | 4/1973 | Tsuzuki et al. | 29/568 |
| 4,304,041 | 12/1981 | Kline et al. | 83/549 X |
| 4,555,966 | 12/1985 | Klingel | 83/549 X |
| 4,569,267 | 2/1986 | Klingel | 83/549 X |
| 4,860,428 | 8/1989 | Brolund et al. | 29/568 |
| 5,012,712 | 5/1991 | Nordquist | 83/549 X |
| 5,027,683 | 7/1991 | Kakimoto | 83/549 X |

FOREIGN PATENT DOCUMENTS

| | | |
|---|---|---|
| 57-177842 | 11/1982 | Japan . |
| 63-281739 | 11/1988 | Japan . |

*Primary Examiner*—Frank T. Yost
*Assistant Examiner*—Rinaldi Rada
*Attorney, Agent, or Firm*—Wenderoth, Lind & Ponack

[57] ABSTRACT

A device for use in a multi-stage former automatically replaces a tool used for successive press work. When the tool is worn or damaged, or when the tool has been used for its estimated life, this condition is detected, whereupon the old tool is automatically removed and replaced by a new one. The device is used in an apparatus wherein a punch is forced against a die by a ram for plastically working a metal by press work, and the device handles the punch mounted on the ram. A punch case or punch holder is utilized to the punch replacing device being assembled therewith.

9 Claims, 6 Drawing Sheets

DEVICE FOR USE IN A FORMER FOR AUTOMATICALLY REPLACING PUNCHES

BACKGROUND OF THE INVENTION

The present invention relates to a device for use in formers which comprise a plurality of dies arranged in a horizontal row and punches disposed in front of the respective dies in opposed relation thereto and movable toward and away from the dies for producing bolts, nuts or various other parts by plastic press work. The device is adapted so that when the punch on the ram side of the former needs to be replaced due to wear or damage, the punch is fully automatically removed and replaced by a new punch in a sequential operation.

Horizontal formers of the multi-stage type are known which comprise a plurality of dies arranged in a horizontal row with punches opposed to the respective dies and movable into striking contact with a metal material for plastic press work. The former usually has four to five pairs of punches and dies for successively striking the material with a high pressure in repetition by the reciprocating movement of the ram. Accordingly, the tools for use in the former can become very markedly worn or damaged. The punches wear more greatly than the dies. A trimming punch (or trimmer punch) and cavity forming punch, especially, undergo several times greater wear than other punches; such that only the trimmer punch or cavity forming punch must be replaced frequently when other punches have not worn substantially.

For example, Unexamined Japanese Patent Publications SHO 57-177842 and SHO 63-281739 disclose devices for use with such horizontal formers of the multi-stage type for replacing a tool using a robot.

The conventional devices have a robotic chuck reciprocatingly movable over a specified section for executing a sequence of replacement procedure, starting with the removal of the old tool and ending with the setting up of a new tool. The replacement therefore requires a considerably long period of time during which the machine needs to be entirely held out of operation. The actual operation of the machine then encounters a serious problem with respect to the work efficiency and productivity. Furthermore, a large apparatus, such as a crane, for robot travel must be provided for one former, necessitating a large space and entailing other problems in respect of cost, etc.

SUMMARY OF THE INVENTION

An object of the present invention is to provide a device for fully automatically replacing a punch in use for press work by a new one through a sequential operation when the old punch is damaged or has been used for its estimated life.

Another object of the invention is to provide a device which is adapted to perform such a sequential replacement operation rapidly and properly without holding the press machine out of operation for a long period of time.

Another object of the invention is to provide a compact and inexpensive device having a simple construction for replacing the punch automatically.

DESCRIPTION OF THE PREFERRED EMBODIMENTS

Figure 1:
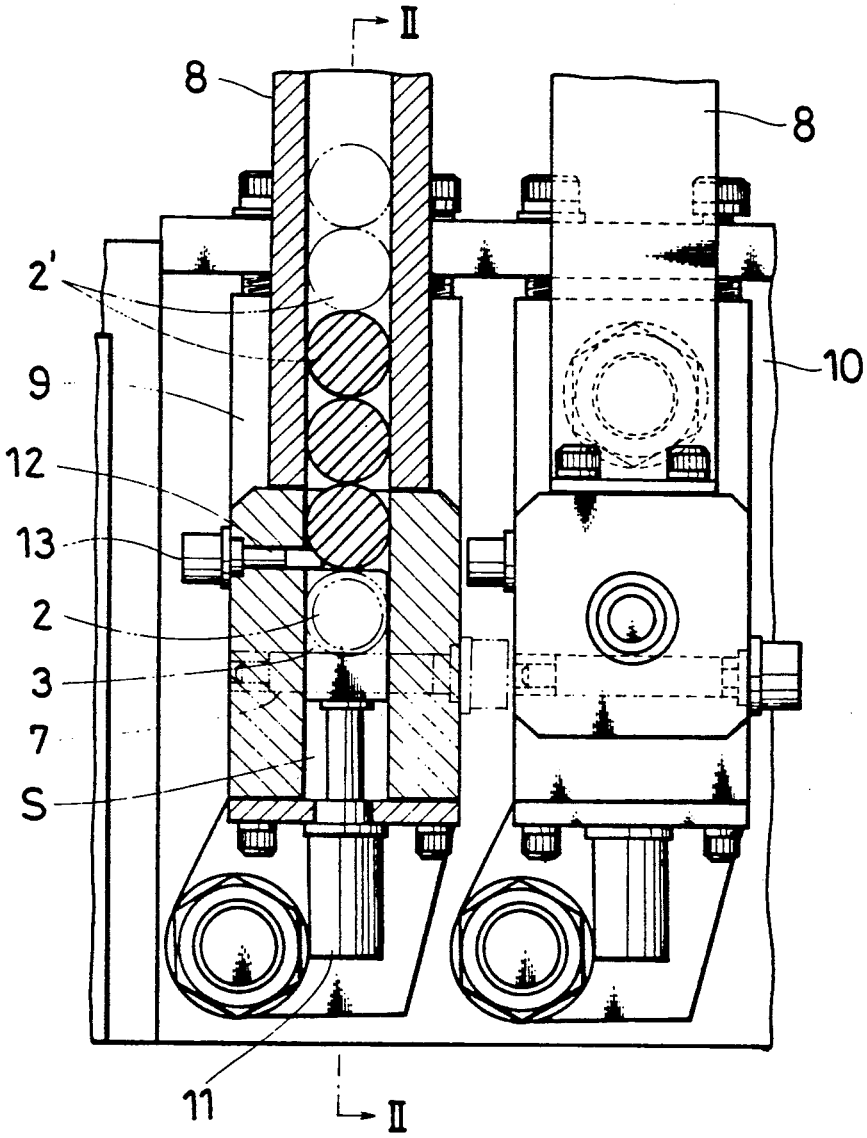
FIG. 1 is a fragmentary front view of a former provided with punch replacing devices embodying the invention, one of the devices being shown in section.
Figure 2:
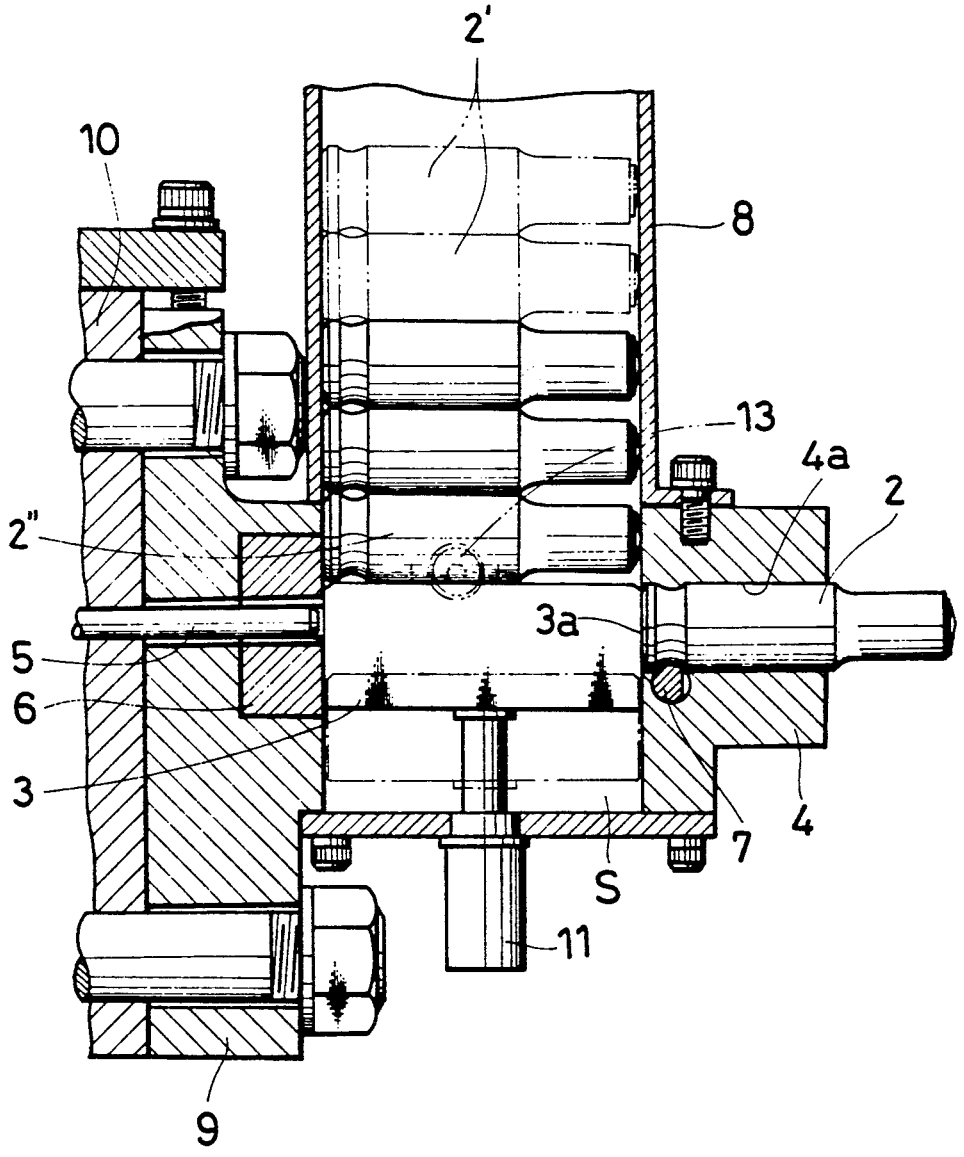
FIG. 2 is a view in section taken along line II—II in FIG. 1.

FIGS. 1 and 2 show a first embodiment of the present invention.

The first embodiment is adapted to handle a punch 2 in the form of an elongated rod and has a space S between a punch case 4 and an impact bearing member 6. A new punch 2' is supplied to the space from above to replace the one in use.

The punch 2 is attached to the front side of a ram 10 by a punch holder 9 and paired with a stationary die (not shown).

The punch case 4 is provided in front of the punch holder 9 integrally therewith and has a hollow portion **4*a* for holding the punch 2** as inserted therein.

The impact bearing member 6 is disposed in the rear of the punch case 4 to provide the space S therebetween. The space S has in its bottom portion a pressure plate 3 movable upward and downward by an air cylinder 11. The space has an upper opening which is provided with a punch stocker 8 for supplying new punches 2' one by one to the space S.

A hollow portion, i.e., bore, **4*a* extends through the punch case 4 in the front-to-rear direction. The punch 2 is removably inserted in the bore 4*a* and usually locked to the case 4 with a lock pin 7**.

The pressure plate 3 is in the form of a rectangular block and is fitted in the space S between the impact bearing member 6 and the punch case 4 so as to be upwardly and downwardly movable. As shown in FIGS. 1 and 2, the pressure plate 3 is usually held in an upper position by the air cylinder 11 and has a front end face **3*a* in bearing contact with the rear end of the punch 2**.

The pressure plate 3 is held in the upper position when the punch 2 is forced against the die for press work.

The new punches 2' to be used for replacement are accommodated in the punch stocker 8 in communication with the upper opening of the space S and delivered from the stocker 8 one by one from the lowermost position.

The punch stocker 8 is adapted to accommodate the new punches 2' placed one above another in a horizontal position. A stopper pin 12 is in engagement with a punch 2'' in the lowermost position to render the pressure plate 3 free of the load of the punches.

The stopper pin 12 is movable by an air cylinder 13. When retracted for the replacement of the punch 2, the pin 12 releases the new punch 2'' , which is then lowered with the descent of the pressure plate 3 and thereby loaded into the space S at the rear of the punch 2.

When the punch 2 is worn or damaged, or when the punch has been used for its predetermined expected life, the lock pin 7 in engagement with the punch 2 rotates in response to a signal to unlock the punch 2. At the same time, the air cylinder 11 operates to lower the pressure plate 3 from the raised position to the phantom-line position shown in FIG. 2.

The new punch 2" at the lowermost position within the stocker 8 is delivered therefrom by the descent of the pressure plate 3 and loaded into the space S at the rear of the old punch 2. Subsequently, a pusher rod 5 is forced out from the ram 10 into the space S by oil pressure, pushing the rear end of the new punch 2" to load the punch 2" into the punch case 4. At the same time, the old punch 2 is forced out from the punch case 4 for replacement.

On completion of the discharge of the old punch 2, the pressure plate 3 moves upward in response to a signal and returns to the original position. The lock pin 7 thereafter rotates to lock the new punch.

When the ram 10 advances to force the punch 2 against the unillustrated die opposed thereto, the rear end of the punch 2 is supported by the pressure plate 3 in the raised position and the impact bearing member 6.

Figure 3:
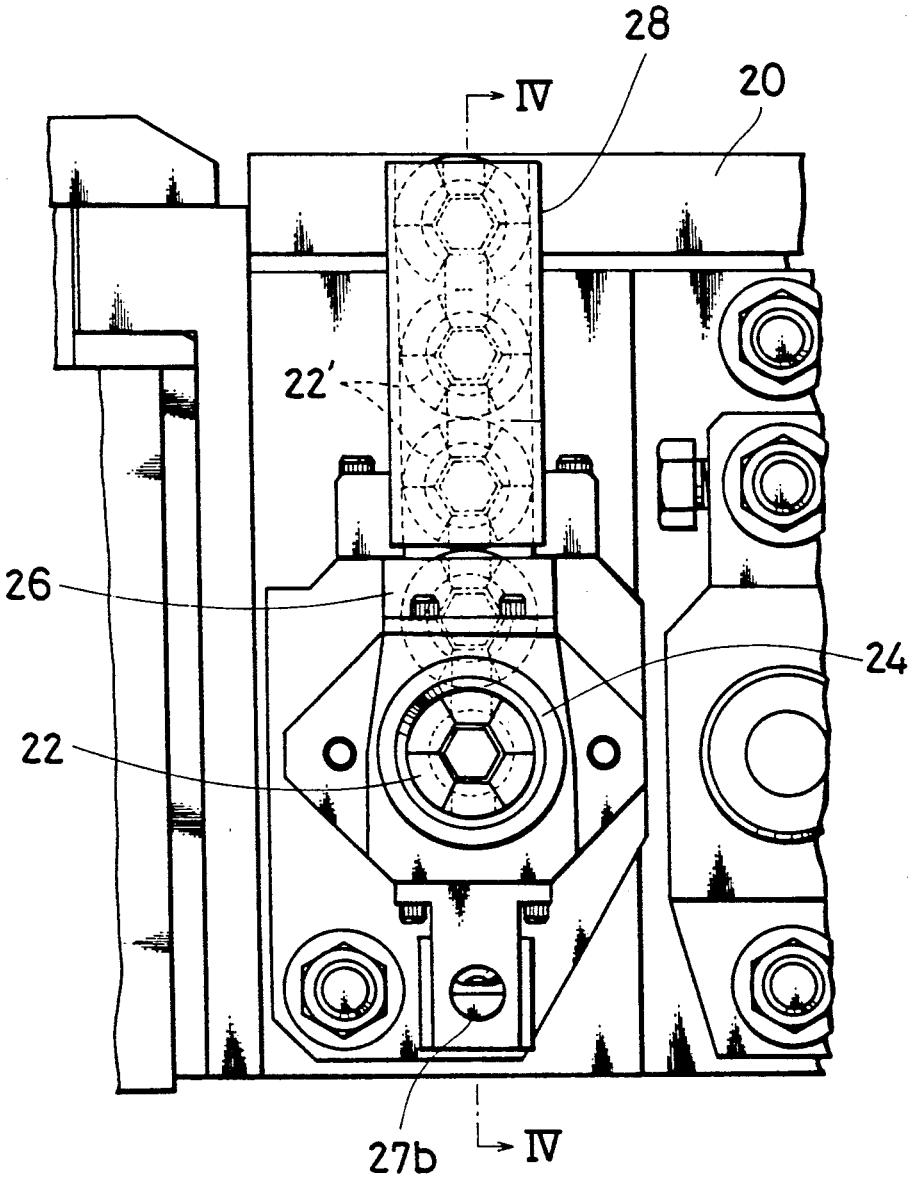
FIG. 3 is a front view showing a second embodiment of the invention.
Figure 4:
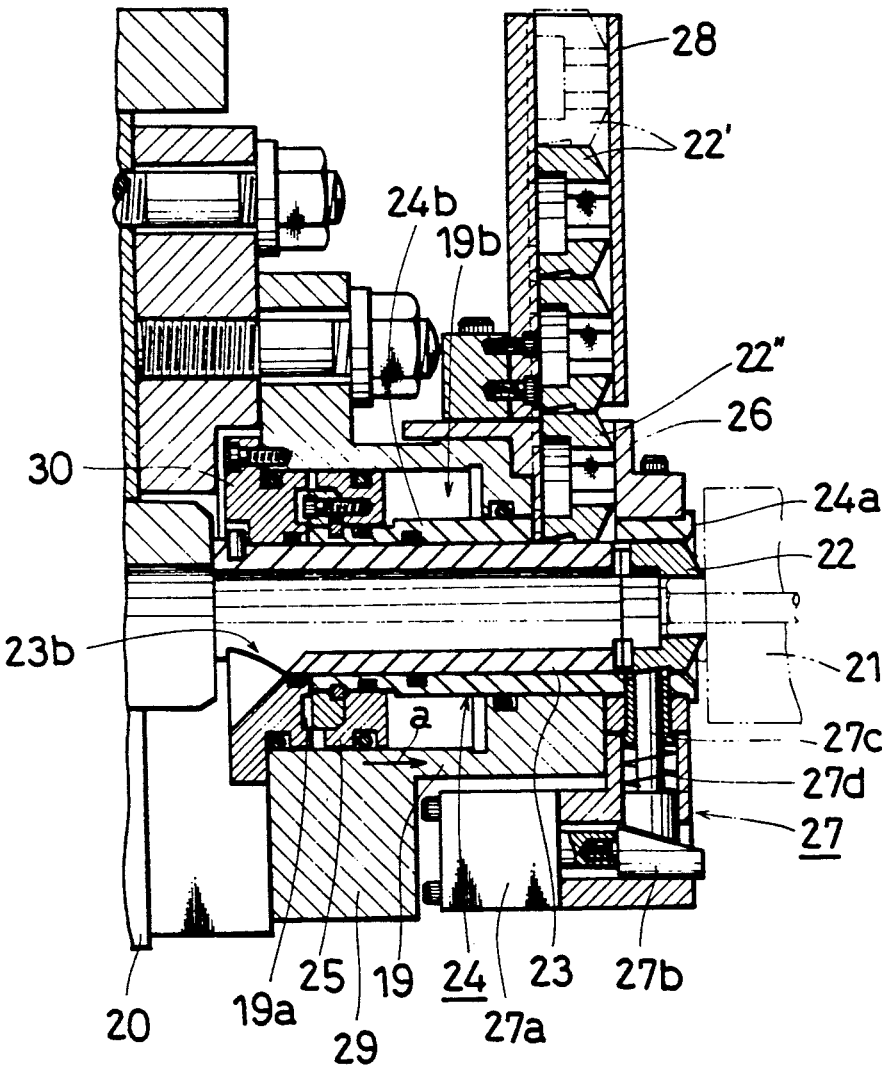
FIG. 4 is a view in section taken along line IV—IV in FIG. 3.

FIGS. 3 and 4 show a second embodiment, wherein when a punch 22 is to be replaced, a punch case 24 is moved forward to form a space for loading a new punch 22' thereinto.

A guide holder 23 serving also as an impact bearing member for the punch 22 is in the form of a hollow cylinder attached to the front side of a ram 20, and has at its rear portion an outlet 23*b* for discharging metal chips.

The punch case 24 comprises a hollow cylindrical portion 24*b* fitted around the guide holder 23 and slidable forward and rearward thereon. A punch holding portion 24*a* is provided at the front end of the portion 24*b* and is integral therewith.

A new punch feeder 26 has is at the front portion of the cylindrical portion 24*b* of the punch case 24 and has a space B which opens upwardly. The upper opening portion of the feeder 26 is joined to a stocker 28 in communication therewith when the punch case 24 is in position.

A lock assembly 27 comprises an air cylinder 27*a* for retracting a cam 27*b*. When the cam is retracted, a lock member 27*c* unlocks the punch 22 by being biased by a spring 27*d*.

A punch holder 29 comprises a cylinder portion 19, the interior of which serves as a hydraulic chamber having a piston 25 fitted therein and slidable forward and rearward. The chamber is divided by the piston 25 into hydraulic compartments 19*a*, 19*b*. The rear end of the cylinder portion 19 is closed with a closure 30.

The piston 25 is attached to the rear end of the cylindrical portion 24*b* of the punch case 24.

Figure 6:
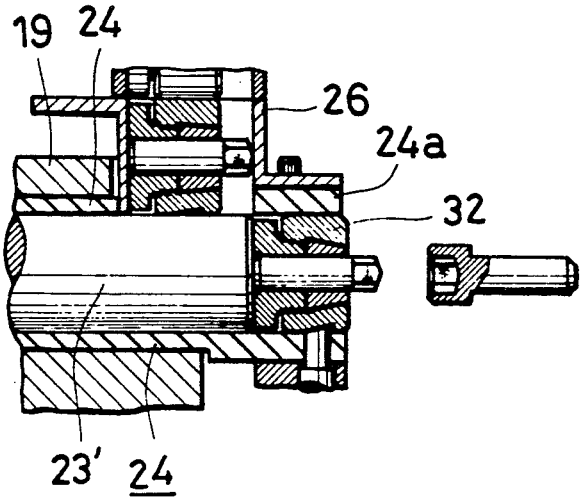
FIGS. 6, 7 and 8 are sectional views of punch replacing devices embodying the invention for handling different punches.
Figure 7:
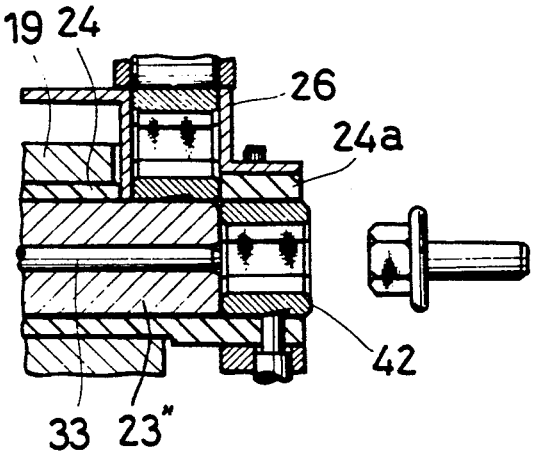
Figure 8:
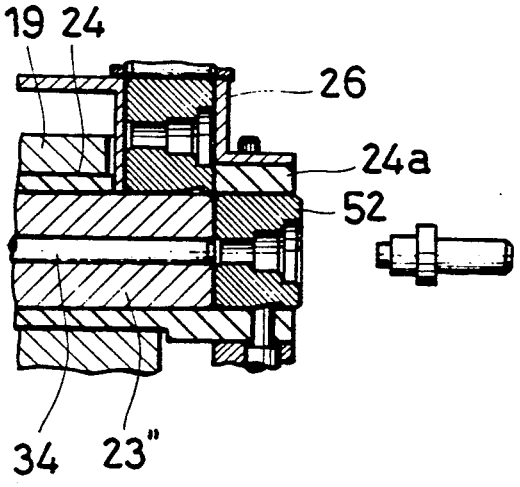

The punch 22 to be handled by the second embodiment is a trimmer punch. Accordingly, the guide holder 23 is in the form of a hollow cylinder. FIG. 6 shows a guide holder 23' which is not hollow for use with a cavity forming punch 32. FIGS. 7 and 8 show devices having a guide holder 23" for punches 42 or 52 for forming a shank end or head portion. The guide holders 23" shown in FIGS. 7 and 8 have knockout pins 33 and, 34, respectively, axially extending therethrough for pushing out the product.

The embodiment of FIGS. 3 and 4 operates in the following manner.

When the punch 22 is to be replaced by a new punch 22", a hydraulic pressure is applied to the hydraulic compartment 19*a* in the cylinder portion 19 of the punch holder 29, with the ram 20 in its retracted position, whereupon the piston 25 is pushed forward hydraulically, with the result that the punch case 24 connected to the piston 25 is moved straight in the direction of arrow a shown in FIG. 4 along the outer periphery of the guide holder 23, being guided thereby. Thus, the punch case 24 is pushed forward over a predetermined stroke length from the position of FIG. 4 to the position of FIG. 5. Since the punch 22 in contact with the front end face 23*a* of the guide holder 23 is pushed forward away from the holder along with the punch case 24, the specified space B is formed between the holder 23 and the punch 22.

Figure 5:
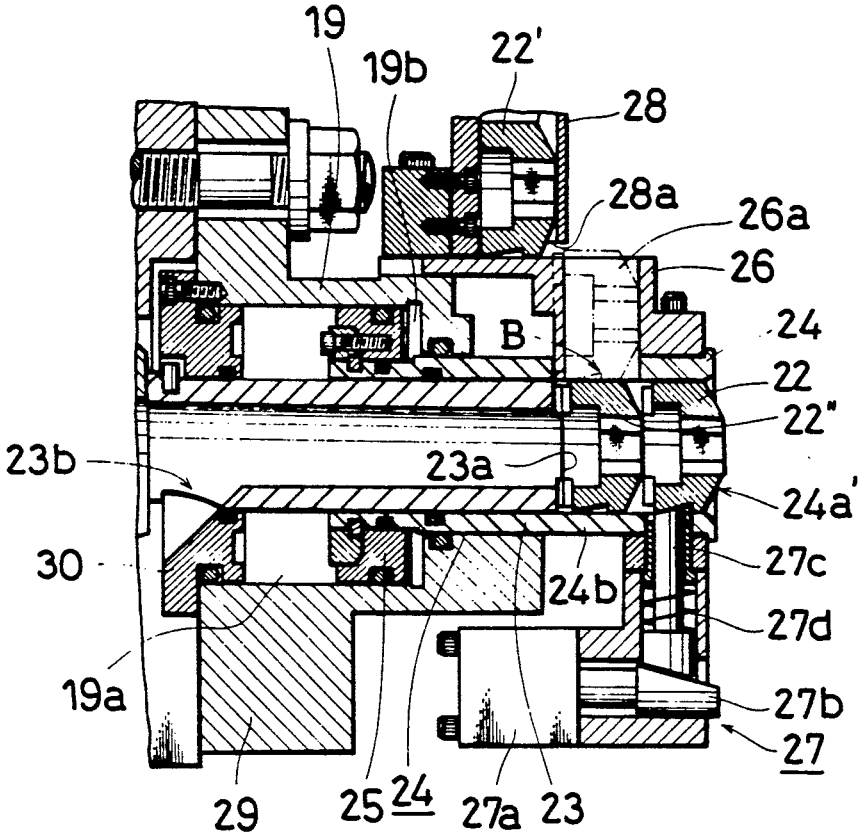
FIG. 5 is a side elevation in vertical section of a punch mount assembly to show a punch replacing procedure.

When the punch case 24 moves forward, the new punch feeder 26 also advances with the case 24. This movement positions the feeder 26 immediately above the space B. Consequently, the new punch 22" accommodated in the feeder 26 falls under gravity and is supplied to the space B (FIG. 5).

Subsequently, the punch 22 held by the holding portion 24*a* at the front end of the punch case 24 is unlocked by the operation of the lock assembly 27 and rendered free.

In this state, hydraulic pressure is applied to the hydraulic compartment 19*b*, causing the piston 25 to retract the punch case 24 to the original position. The retraction of the punch case 24 causes the new punch 22" supplied to the space B to push the punch 22, held in the holding portion 24*a* and previously rendered free, out of the front end opening 24*a*' of the holding portion. At the same time, the new punch 22" is fitted into the holding portion 24*a* of the punch case 24. The lock assembly 27 operates to lock the punch, whereby a sequential replacement operation is completed.

The retraction of the punch case 24 to the original position brings the emptied portion of the punch feeder 26 into register with a lower end opening 28*a* of the punch stocker 28, whereupon the feeder 26 is replenished with another new punch 22' from above.

The devices of the present invention with the construction described above have the following advantages.

With the device according to the first embodiment of the present invention the punch case is not movable, while a pressure plate movable upward and downward is provided in a space formed between the rear end of the punch in use and the impact bearing member. A new punch supplied from above the plate is loaded into place in the rear of the old punch with the descent of the pressure plate. The new punch can be loaded into the punch case by the action of the pusher rod to push out the old punch for automatic replacement of the punch. Moreover, the punch can thus be replaced rapidly and reliably without entirely holding the machine out of operation.

With the device according to the second embodiment of the present invention the punch holder is in the form of a hydraulic cylinder and has a punch case in the form of a hollow cylinder and is provided so as to be slidable forward and rearward relative to a guide holder by a piston. Thus, the punch holder and the punch case are utilized for readily replacing the punch without using a respecially large and complex arrangement.

Further, with use of the automatic lock assembly the punch held by the punch holder can be automatically locked or unlocked, so that the entire process for handling the punch, including the supply, installation and removal thereof, can be practiced fully automatically.

What is claimed is:

1. In a former having a body frame with a fixed portion for mounting a die and a ram with a punch mounted thereon opposite to the die so as to be movable toward and away from the die, an automatic punch replacing device comprising:

a punch holder attached to a front end face of the ram;

a punch case projecting forward from said punch holder for holding a punch therein;

an impact bearing member on said punch holder for bearing an impact of a punch during operation of the former;

a space defined between said impact bearing member and said punch case having a size sufficient to accommodate a new punch therein, said space having an opening;

a punch stocker communicating with said opening for accommodating therein new punches to be supplied to said space;

a pusher rod movably mounted in said punch holder along an axis thereof for moving forward into said space for pushing a new punch from said space to said punch case and retracting from said space;

a pressure plate comprising a block upwardly and downwardly movably mounted in said space for movement between a raised position between said impact bearing member and a punch held by said punch case in order to bear the impact of the punch while the former is in operation and a lowered position permitting the delivery of a new punch from said punch stocker into said space in front of said pusher rod.

2. The automatic punch replacing device of claim 1, and further comprising a lock assembly holding and releasing a punch in said punch case.

3. The automatic punch replacing device of claim 1, wherein said block of said pressure plate has a fluid cylinder operatively connected thereto for moving said block in said space.

4. The automatic punch replacing device of claim 1, wherein said opening of said space faces vertically upward and said punch stocker extends vertically upward from said opening.

5. In a former having a body frame with a fixed portion for mounting a die and a ram with a punch mounted thereon opposite to the die so as to be movable toward and away from the die, an automatic punch replacing device comprising:

a punch holder attached to a front end face of the ram, said punch holder having a hollow cylindrical guide holder mounted thereto for bearing an impact of a punch during operation of the former and a hydraulic cylinder portion defining a closed hydraulic chamber;

a hollow cylindrical punch case surrounding said cylindrical guide holder and mounted thereon so as to be slidably moveable forwardly and rearwardly on said cylindrical guide holder, said hollow cylindrical punch case having a piston attached thereto and fitted in said hydraulic chamber of said punch holder for hydraulically moving said punch case back and forth over a predetermined stroke length, and said hollow cylindrical punch case further having a punch holding portion for holding a punch at a front end of said cylindrical guide holder; and a new punch feeder integrally mounted with said punch case for receiving a new punch and feeding the new punch to said punch holding portion.

6. The automatic punch replacing device of claim 5, wherein said punch holder has a closure at a rear end thereof, said hydraulic chamber being defined between said hydraulic cylinder portion of said punch holder, said closure and said cylindrical guide holder.

7. The automatic punch replacing device of claim 5 wherein said punch holding portion is a cylindrical portion of said punch case moveable therewith to a position spaced from the front end of said guide holder for allowing a new punch to fall from said new punch feeder to a position in front of said guide holder.

8. The automatic punch replacing device of claim 5, wherein said punch case has an upper opening communicating with said new punch feeder and said new punch feeder has a punch stocker mounted thereon for feeding new punches thereto.

9. The automatic punch replacing device of claim 5, and further comprising a lock assembly for holding and releasing a punch in said punch holding portion of said punch case.

* * * * *